US007328901B2

(12) United States Patent
Bunn et al.

(10) Patent No.: US 7,328,901 B2
(45) Date of Patent: Feb. 12, 2008

(54) CASINO CRAPS CARD GAME

(75) Inventors: Cynthia Jean Bunn, Miami, OK (US); Kirk Jeremy Myrick, Miami, OK (US); JR Mathews, Miami, OK (US); George D. Joseph, Las Vegas, NV (US)

(73) Assignee: Quapaw Gaming Corporation, Quapaw, OK (US)

( * ) Notice: Subject to any disclaimer, the term of this patent is extended or adjusted under 35 U.S.C. 154(b) by 25 days.

(21) Appl. No.: 11/308,223

(22) Filed: Mar. 13, 2006

(65) Prior Publication Data

US 2007/0210513 A1 Sep. 13, 2007

(51) Int. Cl.
*A63F 1/00* (2006.01)
*A63F 9/04* (2006.01)

(52) U.S. Cl. ..... 273/274; 273/292; 273/309; 273/138.1; 273/138.2; 273/146

(58) Field of Classification Search ..... 273/274, 273/138.1, 138.2, 146, 292, 309; 463/16, 463/22

See application file for complete search history.

(56) References Cited

U.S. PATENT DOCUMENTS 6,913,262 B2 * 7/2005 Berman ..... 273/292
2003/0032471 A1 * 2/2003 Darder ..... 463/16

OTHER PUBLICATIONS

Frank Scoblete, "Beat The Crap Out of the Casinos", Bonus Books, Chicago, Illinois, 2004, pp. 8-15.
Avery Cardoza, "Casino Craps For The Winner", Cardoza Publishing, New York, New York, 1998, pp. 12-25, 32-37.
Edwin Silberstang, "Winning Casino Craps", David McKay Company, Inc., New York, New York, 1979, pp. 1-9.

* cited by examiner

*Primary Examiner*—Benjamin Layno
(74) *Attorney, Agent, or Firm*—Head, Johnson & Kachigian

(57) ABSTRACT

A method for playing a game played by at least one player having both numbered playing cards and a pair of dice. The method for the game includes randomizing at least six of the playing cards, wherein each card contains a single digit from one to six. The playing cards are then inserted into a series of boxes or slots on a table wherein the boxes or slots correspond to the digits one through six. One player is offered an opportunity to be a dealer and is provided with a pair of six-sided dice. The dice are rolled by the dealer and the outcome of the playing card or cards is determined and the total of the cards is determined by the outcome of the dice. Winners and losers are determined from the card or the cards. A series of additional steps may be employed thereafter in accordance with traditional casino craps gaming rules.

9 Claims, 1 Drawing Sheet

CASINO CRAPS CARD GAME

BACKGROUND OF THE INVENTION

1. Field of the Invention

The present invention relates to a method or process for playing a game that includes both dice and playing cards. In particular, the present invention is directed to a method for playing a modified and improved casino craps game which incorporates use of both playing cards and a pair of dice with the cards being the deciding factor in the outcome of the game.

2. Prior Art

The game of casino craps is a well-known, fast and exciting game which is played in a number of venues including casino gaming locales, such as Las Vegas.

The game may take slightly different permutations however, the basic form and format is similar from game to game and from place to place.

In the traditional casino craps game, a substantially rectangular game table is utilized with a printed or other layout arrangement of boxes, spaces and other areas showing various types of wagers or bets which are permitted. The table traditionally is flat with a series of upstanding walls against which a pair of dice are rolled. Wagers or bets are made by placing chips, gaming cheques or sometimes cash on the appropriate areas of the layout.

Anywhere from one to twenty players or more may play the game at one time. The traditional casino craps game is played with two standard six-sided dice with each die numbered from one to six.

Different personnel may be utilized, however, a crew of four employees is standard. Typically there will be a stickman whose responsibility is handling of the dice which may be performed with a flexible, hooked stick. When a new shooter or dice roller is beginning, the stickman will offer him or her a choice of five dice to choose from and then will return and retain the remaining three dice. The stickman is also responsible for the proposition, or center, bets to be described herein in detail. If the bets are winners, the stickman will direct the dealers to pay off the winning players, and if the bets are losers, the stickman will collect the lost proposition bets.

There is typically a dealer located on either side of a box man. The dealer's main responsibility is to handle all of the monetary transactions in betting on the ends of the table. The dealer pays off winning bets and collects losing ones. Each standing dealer also typically has a mark or puck, a disk used to indicate the established point, to be described herein.

A box man sits between the pair of dealers across from the stickman and supervises the running of the table. The box man is also responsible for settling any disputes that may arise.

In traditional play of the casino craps game, the stickman will present five dice to a new player, then known as a shooter, who will select a pair of dice to use. In a new game, the player closest to the box man's left side will receive the dice first and rotation of the dice will go clockwise from player to player around the table.

The play starts when the shooter shakes the dice and rolls them the length of the table. The first roll by the shooter is called the "come-out roll" and the dice determine immediate winners and losers.

Players making Pass Line wagers, betting that the shooter will pass, or win, are hoping that the come-out roll is a 7 or an 11, an automatic winner. For Pass Line wagers, a 7 or an 11 is an automatic win. In most cases, the win is even money—so that a $5 wager returns $5 plus $5.

If the dice roll 2, 3 or 12, the Pass Line wagers are automatic losers. If the dice roll any of the remaining numbers, 4, 5, 6, 8, 9 or 10, this establishes a point. When a point is established, no one wins or losers the first roll.

Conversely, players making "Don't Pass" wagers bet against the dice and are hoping for just the opposite. A 7 or an 11 thrown on the come-out roll is an automatic loser for Don't Pass wagers while the 2, 3 or 12 are automatic winners.

Once a point is established, there are only two numbers that matter to the Pass or Don't Pass betters, the 7 and the point that has been established. If the 7 is thrown before the point repeats, then the Pass Line betters lose and Don't Pass betters win—usually even money. If the point repeats before the 7 is rolled, then the Pass Line betters win and Don't Pass betters lose (even money). In that case, play continues until a 7 or the point is made.

Once a point has been established on the Pass Line, betters can place free odds behind the line as an optional, additional bet. That is, they can place an amount equal to, double, or higher behind their Pass Line wagers.

In addition, Free Odds wagers may be placed after a point is established equal to, double, or higher than the amount bet on the Pass Line.

There are a number of other areas for gaming or betting on the casino craps table. After the come-out roll, and after the shooter establishes a point, then it is possible to place an optional bet in the Come area or Don't Come area of the table layout. If the shooter rolls a 7 or 11, then the Come bet wins—usually even money. If the shooter rolls a 12, 3, or 2, the Come bet loses. Conversely, if the shooter rolls a 7 or 11, the Don't Come bet loses. If the shooter rolls a 3, 2, or 12, the Don't Come bet wins. If the shooter rolls a point, the bet is placed by the dealer in a series of numbered boxes adjacent the Come box and the bet is said to travel. The player also has the choice to then take odds. If the next roll is the number, then the player wins. Come Bets stay on the table until that number is made or until there is a seven out.

Place bets are an additional, separate, optional betting area which may be played after a point is established. Place bets are typically designated as small rectangles with all of the point numbers. A bet on one of the place numbers bets that the number will repeat before a 7 is thrown. Place bets may be made at any time after the come-out roll.

Field bets or wagers are also optional wagers that may be placed. Field bets are placed on spaces on the table and are one-roll bets, depending on the next roll of the dice. They are then paid off or lost immediately. Field bets consist of the following numbers: 2, 3, 4, 9, 10, 11, and 12. The number 2 is paid at odds of 2 to 1 and the number 12 is paid at odds of 3 to 1. The numbers 3, 4, 9, 10 and 11 are paid at odds of 1 to 1. The field bet loses on numbers 5, 6, 7, and 8.

Proposition bets, also known as "prop" bets, are a multitude of optional wagers located in the center of the craps table layout. The proposition bets are divided into two types of bets—the hardways and the one-roll bets. Proposition bets are normally placed after the come-out roll unless otherwise specified. The hardways bets are on the exact combination of numbers from the dice. Hardway bets win if the selected dice are dealt before a 7 or the easy combination of that particular number is dealt. The one-roll bets include any 7, any craps, 3 or 11, 2 or 12, horn bet, C and E, hop bet, or world bet.

In some states of the United States and other jurisdictions, traditional casino craps gaming is not permitted, however, games are permitted wherein playing cards determine the outcome of the play and the outcome of any betting thereon. Accordingly, it is a principal object and purpose of the present invention to provide a modified game wherein the outcome of playing cards determines the outcome of the game.

It is a further object and purpose of the present invention to provide a modified game wherein the outcome of the playing cards is required to determine the outcome of the game.

Additionally, while the standard casino craps game is well known, it would be beneficial to provide a modified game with variations thereto to stimulate interest. Accordingly, it is a further object and purpose of the present invention to provide a modified and improved casino craps card game to stimulate interest therein.

SUMMARY OF THE INVENTION

The present invention is directed to a modified casino craps card game which incorporates use of both playing cards and a pair of dice, with the cards being the deciding factor in the outcome of the game.

In a preferred embodiment of the game, the gaming table includes a printed or other layout arrangement of boxes, spaces and other areas for various types of wagers or bets permitted during the game. One area of the gaming table includes a series of boxes or slots wherein each box or slot contains an individual digit from one to six. The numbers in the boxes or slots will correspond to the roll of the dice. As an initial step, six playing cards are randomized through one of the various number of methods. In a preferred method, the cards are initially turned face down so that the card numbers may not be identified. The cards are thereafter mixed together and then one card is placed in each of the six boxes or slots. Thereafter, the cards are turned face up so that each of the numbered boxes has a single card therein with a single number ranging from one through six.

One player will be offered an opportunity to be a dealer and be provided with a pair of dice. Before each roll of dice, betters are permitted to place bets or wagers on the table in the desired locations. The dealer will be permitted to roll the dice on the top of the table so that they strike against one of the upstanding walls and come to rest. By way of example, if the roll of the dice produces a 2 and a 4, the cards residing in the number 2 box and the number 4 box will be pushed forward slightly to indicate that those are the cards used to determine winning and losing numbers for the game. The cards thereby determine the play.

It will be seen, therefore, that the winners and losers are determined from the card or cards and not directly from the roll of the dice.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
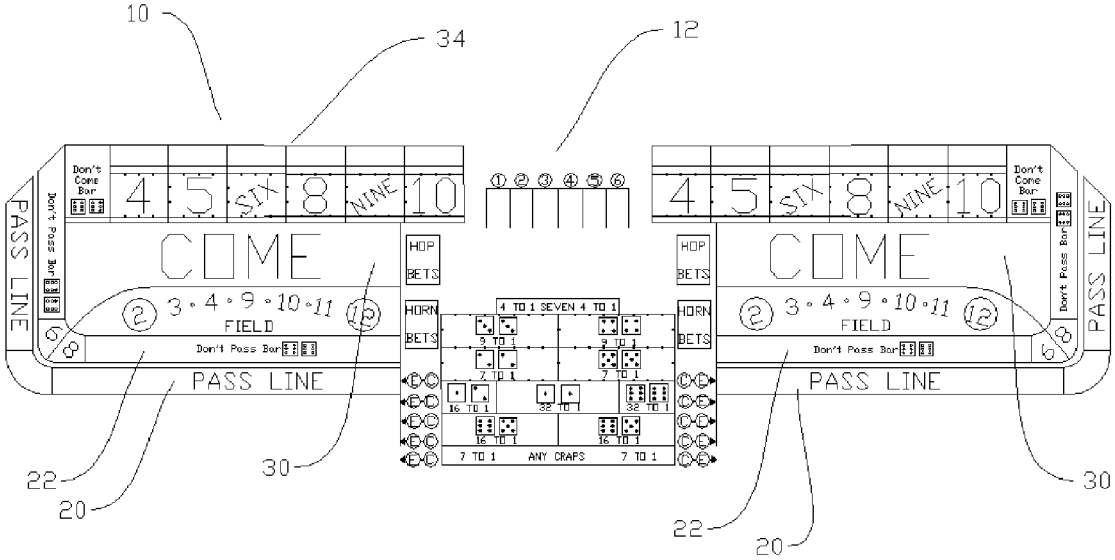
FIG. 1 is a diagrammatic view of a game table for a casino craps card game in accordance with the present invention.

Referring to the drawings in detail, FIG. 1 illustrates a diagrammatic view of a game table constructed in accordance with the present invention for playing the method of the game claimed herein.

The gaming table 10 includes a printed or other layout arrangement of boxes, spaces and other areas showing places for various types of wagers or bets which are permitted during the game. The table is traditionally flat with a series of upstanding walls (not shown). Wagers or bets are made by placing chips or game cheques on the appropriate areas of the layout. Players stand around the edge of the gaming table and anywhere from one to twenty or more players may play at one time. Two standard six-sided cubic dice are utilized with each die numbered from one to six. A roll of the dice, therefore, results in the numbers from 2 to 12.

Figure 2:
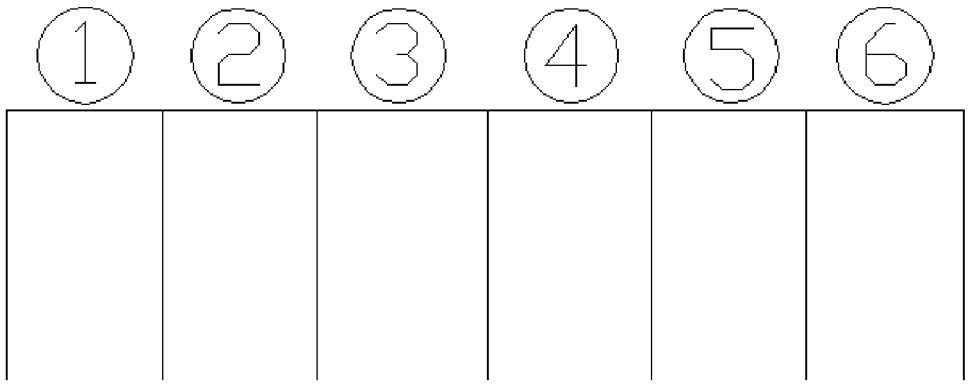
FIG. 2 is a diagrammatic view of a portion of the game table shown in FIG. 1 showing boxes or slots for receipt of playing cards.

One area of the gaming table 10 includes a series of boxes or slots 12 wherein each box or slot contains an individual digit from 1 to 6. FIG. 2 illustrates an enlarged view of the boxes or slots for ease of comprehension. The boxes or slots 12 are equal to or slightly larger in size than a series of playing cards. The six cards may be referred to a "six card set". Each card contains a single digit from one to six. An ace may be used to represent one.

The boxes or slots are numbered consecutively from 1 to 6. The numbers in the boxes or slots will correspond to the roll of the dice as will be explained herein.

As an initial step, the six playing cards are randomized through one of a various number of methods. In one preferred method of randomizing of the playing cards, the cards are initially turned face down so that the card numbers may not be identified. The cards are thereafter mixed together and then one card is placed in each of the six boxes or slots 12. Once this has been accomplished, the cards are then turned face up so that each of the numbered boxes or slots 12 has a single card therein with a number ranging from 1 through 6.

The cards may also be randomized in various other ways within the spirit and scope of the present invention. For example, the card residing in the number 1 box may be moved and placed in the 6 box and thereafter moving all of the box cards to the right one box.

A further method of randomizing the cards would be to shuffle the cards periodically and then replace them in the boxes or slots 12. The frequency of the randomization will be determined by the game operators but will typically only be performed after the round is completed and before another round of play begins.

Either before or thereafter, one player in the game will be offered an opportunity to be a dealer and thereby be provided with a pair of dice.

Before each roll of the dice, the game may be established so that an ante or wager must be entered by each player. For example, a $1.00 ante may be required per round. Before each roll of the dice, betters are permitted to place bets or wagers on the tables in the desired locations.

Once the dealer has been provided and selected a pair of dice and the wagering has been completed, the dealer will be permitted to roll the dice on the top of the table so that they strike against one of the upstanding walls and come to rest.

If, for example, the roll of the dice produce a 2 and a 4, the cards residing in the number 2 box and the number 4 box will be pushed forward slightly to indicate that those are the cards used to determine winning and losing numbers for the game. The cards will then determine the play. It will be seen, therefore, that the winners and losers are determined from the card or cards and not directly from the roll of the dice.

Once the foregoing series of steps have been accomplished, the play of the game may follow traditional casino craps rules. In one system, the first roll of the dice is the "come-out" roll and determines the cards in the boxes or slots which determines the winners or losers. Players bet on the Pass Line 20 or on the Don't Pass Line or Don't Pass Bar 22. Players making Pass Line wagers bet that the shooter will pass or win, and hope that the come-out number is a 7 or an 11 which is an automatic winner. If the cards total 2, 3, or 12, the Pass Line wagers are automatic losers. If the combination of the two cards total any of the remaining numbers, 4, 5, 6, 8, 9 or 10, the establishes a point. When a point is established, no one wins or loses on the first roll.

Conversely, players making "Don't Pass" wagers bet against the cards and are hoping for just the opposite. A 7 or an 11 on the come-out is an automatic loser for Don't Pass wagers while the total of the cards totaling 2, 3, or 12 are automatic winners. Once a point is established, there are only two numbers that matter to the Pass or Don't Pass betters, the 7 and the point that has been established. If the two cards total 7 before the point repeats, then the Pass Line betters lose and the Don't Pass betters win. If the point repeats before the cards total 7, then the Pass Line betters win and the Don't Pass betters lose. In that case, play continues until a 7 or the point is made.

In addition, Free Odds wagers may be placed after a point is established equal to, double, or higher than the amount bet on the Pass Line.

There may be a variety of other areas for gaming or betting on the table 10. After the come-out roll, and after a point is established, it is possible to place an optional bet in the Come area of the layout table 30. If the cards total 7 or 11, then the Come bet wins. If the cards total 12, 3 or 2, the Come bet loses. Conversely, if the total of the cards is a 7 or 11, the Don't Come bet loses. If the total of the cards is a 3, 2, or 12, the Don't Come bet wins. If the cards total a point, the bet is placed by the dealer in a series of numbered boxes adjacent the Come box as shown at reference numeral 34 and the bet is said to travel. The player also has the chance to then take odds. If the next roll is the number, then the player wins. Come Bets stay on the table until that number is made or until there is a seven out.

Another optional, additional separate betting area is the Place bets. Place bets are typically designated as small rectangles with all of the point numbers. A bet on one of the place numbers bets that the number will repeat before a 7 is totaled by the cards. Place bets may be made at any time after the come-out roll. Field bets are also additional, optional bets or wagers that may be placed.

Field bets or wagers are also optional wagers that may be placed. Field bets are placed on spaces on the table and are one-roll bets, depending on the next outcome of the cards. They are then paid off or lost immediately. Field bets consist of the following numbers: 2, 3, 4, 9, 10, 11, and 12. The number 2 is paid at odds of 2 to 1 and the number 12 is paid at odds of 3 to 1. The numbers 3, 4, 9, 10 and 11 are paid at odds of 1 to 1. The field bet loses on numbers 5, 6, 7, and 8.

Proposition bets, also known as "prop" bets, are a multitude of optional wagers located in the center of the craps table layout. The proposition bets are divided into two types of bets—the hardways and the one-roll bets. Proposition bets are normally placed after the come-out roll unless otherwise specified. The hardways bets are on the exact combination of numbers from the cards. Hardway bets win if the selected cards appear before a 7 or the easy combination of that particular number appears. The one-roll bets include any 7, any craps, 3 or 11, 2 or 12, horn bet, C and E, hop bet, or world bet.

Whereas, the present invention has been described in relation to the drawings attached hereto, it should be understood that other and further modifications, apart from those shown or suggested herein, may be made within the spirit and scope of this invention.

What is claimed is:

1. A method for a game played by at least one player having both numbered playing cards and a pair of dice, which method comprises:

providing playing cards consisting of only six playing cards;

randomizing said six of said playing cards, wherein each said card contains a single digit from one to six;

thereafter inserting each of said playing cards in one of six areas, boxes or slots on a table, wherein said areas, boxes or slots correspond to the digits one through six;

thereafter offering one said player an opportunity to be a dealer and providing said pair of dice to said dealer;

thereafter rolling said pair of dice by said dealer;

thereafter selecting an area, box or slot corresponding to the outcome of each of the dice;

thereafter determining the outcome of said playing card or cards and a total of said cards by said selected areas, boxes or slots corresponding to the outcome of said dice; and thereafter determining winners and losers from said card or said cards.

2. A method for a game played by at least one player as set forth in claim 1 wherein said digit one is symbolized by an ace.

3. A method for a game played by at least one player as set forth in claim 1 wherein said step of randomizing of said playing cards includes turning said cards face down and mixing together before said step of inserting into said areas, boxes or slots.

4. A method for a game played by at least one player as set forth in claim 1 wherein said step of randomizing of said cards includes moving one said card from one said area, box or slot to another and thereafter moving the remaining cards to adjacent boxes.

5. A method for a game played by at least one player as set forth in claim 1 including an initial step of each said player paying an ante.

6. A method for a game played by at least one player as set forth in claim 1 wherein said players are permitted to place bets before said rolling of said dice.

7. A method for a game played by at least one player as set forth in claim 1 including a series of additional steps in accordance with traditional casino craps gaming rules.

8. A method for a game played by at least one player as set forth in claim 1 wherein said table is substantially rectangular in shape with upstanding walls and includes a table top with two identical end sections and a center section.

9. A method for a game played by at least one player as set forth in claim 8 wherein said two identical sections include come bets, pass line bets and field bets, and wherein said center section includes proposition bets.

* * * * *